United States Patent [19]

Mehlberg

[11] Patent Number: 4,802,975

[45] Date of Patent: Feb. 7, 1989

[54] METHOD FOR STRIPPING OF RESIDUAL SOLVENT

[75] Inventor: Robert L. Mehlberg, Wheaton, Ill.

[73] Assignee: Amoco Corporation, Chicago, Ill.

[21] Appl. No.: 82,085

[22] Filed: Aug. 5, 1987

Related U.S. Application Data

[63] Continuation of Ser. No. 758,339, Jul. 24, 1985, abandoned, and Ser. No. 594,755, Mar. 29, 1984, abandoned.

[51] Int. Cl.[4] ..... C10G 1/04

[52] U.S. Cl. ..... 208/390; 208/391

[58] Field of Search ..... 208/390, 391

[56] References Cited

U.S. PATENT DOCUMENTS

| | | | |
|---|---|---|---|
| 3,475,318 | 10/1969 | Gable | 208/390 |
| 4,139,450 | 2/1979 | Hanson | 208/390 |
| 4,167,470 | 9/1979 | Karnofsky | 208/390 |
| 4,347,118 | 8/1982 | Funk | 208/390 |

OTHER PUBLICATIONS

Ellerbe "Steam Distillation/Stripping", in Handbook of Separation Techniques for Chemical Engineers, 1979.

Perry "Chemical Engineer's Handbook", pp. 18-1, 18-19, 18-20, (1973).

*Primary Examiner*—Asok Pal

[57] ABSTRACT

A method for stripping adsorbed organic solvent from a solid comprising feeding a slurry of the solid containing the adsorbed solvent into a packed column and countercurrently contacting the slurry with stripping gas, removing an overhead stream comprising desorbed solvent and a bottom stream comprising a solvent stripped solids slurry. A preferred embodiment uses a vertical packed column, an aqueous slurry of the solid, and steam as the stripping gas. The method is particularly suitable for stripping extraction solvents from spent tar sands or spent diatomite resulting from bitumen extraction methods.

The vertical packed-bed stripping column has two separate zones: (a) a hot stripping zone where the feed enters at the top and the hot stripping gas enters at the bottom of the hot stripping zone; (b) and a cold stripping zone where the depleted feed from the hot stripping zone enters at the top and a cold stripping gas is introduced at the bottom of th cold stripping zone. The lower stripping zone is maintained at a temperature less than the upper zone of the same stripping column.

22 Claims, 1 Drawing Sheet

METHOD FOR STRIPPING OF RESIDUAL SOLVENT

This is a continuation of application Ser. No. 758,339 filed July 24, 1985 are application Ser. No. 594,755 filed Mar. 29, 1984, both now abandoned.

This invention relates generally to recovery of volatile organic materials, and more particularly relates to a method for recovering an adsorbed volatile material such as an organic solvent from a solid by countercurrent contacting in a packed column of a slurry containing the solid and adsorbed hydrocarbon with a stripping gas.

BACKGROUND OF THE INVENTION

Extraction of a predetermined component from a composition comprising the predetermined component with organic solvents is conventional. For example, caffeine is extracted from coffee beans with chlorinated hydrocarbons such as methylene chloride to produce decaffeinated coffee, and soybean oil is extracted from soybeans with hexane. In all these methods, residual amounts of the solvent must be recovered from the extracted solids to limit solvent make-up costs.

Methods have also been disclosed for solvent extraction of bitumen from bitumen containing tar sands. Typically, these methods involve comminuting the tar sand, contacting the tar sand with about 2 to about 10 parts of solvent per part of bitumen present in the tar sand, and separating a bitumen solvent phase from spent tar sand. However, the residual solvent is difficult to remove from the spent tar sands because the solvent is strongly adsorbed.

The residual solvent is generally recovered from spent tar sands by heating to evaporate the solvent. Heating tar sands tailings in indirect surface exchangers such as evaporative dryers is expensive because of solids handling difficulties, dust problems, expensive heat transfer surface area, high heating demands to remove the last trace amounts, and poor heat recovery. Thus, lower cost processes for solvent recovery in bitumen extraction are important.

U.S. Pat. No. 3,475,318, "Selective Solvent Extraction Plus Filtration of Tar Sands", Gable, issued Oct. 28, 1969, discloses solvent recovery from spent tar sands by steam stripping. In one embodiment the spent sands are placed on a filter and steam is pushed or pulled through the spent sand by a pressure drop across the filter bed, thereby stripping off the solvent. In another embodiment steam is passed through the spent tar sands on the filter until just prior to steam breakthrough at the bottom of the filter bed. The partially steamed sand is then passed into a rotary kiln dryer where solvent is stripped from the sand with steam entering the dryer in a direction essentially countercurrent to the sand. Gable does not disclose steam stripping in a packed column.

Steam stripping has also been used to remove ethanol from fermentation mashes containing suspended fine solids. In this method the fermentation mass slurry is countercurrently contacted with steam in a stripping column with disk-donut trays. However, the fermentation slurries have solids concentrations less than 10 weight % and the ethanol is dissolved in the slurry fluid rather than adsorbed on the fine solids.

None of the disclosed methods of solvent stripping from spent tar sand tailings, however, employ treating a slurry of the spent sand. None of the disclosed methods strip the solvent from the spent sand. It is therefore an object of the invention to strip residual solvent from spent tar sands in a packed column. It is a further object to achieve substantially complete solvent removal from spent tar sand. Yet another object is an energy efficient solvent stripping method capable of operating at high flow rates. Other objects appear below.

SUMMARY OF THE INVENTION

Applicant has found that adsorbed solvent can be advantageously stripped from an aqueous slurry of spent tar sand through countercurrent contact with a stripping gas in a packed column. The invention thus comprises a method for recovery of adsorbed solvent from a solid comprising introducing a slurry of a solid containing adsorbed organic solvent into a packed column near one end; introducing stripping gas into the column near the opposite end to countercurrently contact the slurry; removing a column overhead stream comprising desorbed organic solvent; and removing a column bottom stream comprising a solvent stripped solid slurry. The packed column is preferably a vertical column packed internally with mass-transfer or contact devices.

The stripping technique of the invention advantageously is applicable to solvent recovery from any spent solid material. Surprisingly, a fast, continuous stripping of solvent from the solids in a high solids content slurry by countercurrent contact with stripping gas in a packed column occurs without plugging of the column. The invention thus has the further advantages of efficient handling of high solids content spent tar sand slurries, high mass transfer rates for the stripping; high energy efficiency; low operating and maintenance costs; and dustless handling of spent tar sands.

DESCRIPTION OF THE INVENTION

Figure 1:
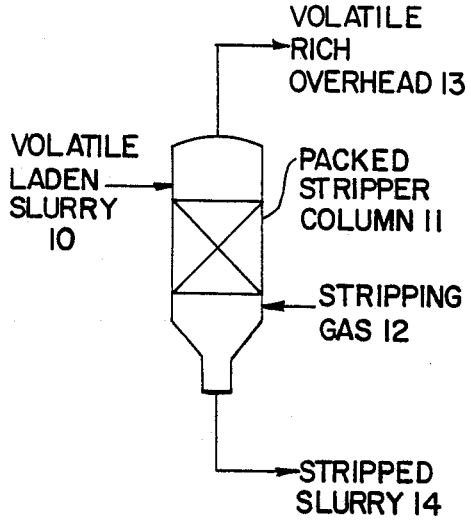
FIG. 1 shows a vertical stripping column used in the invention.

The invention is directed to the technical problem of stripping an adsorbed organic solvent such as a hydrocarbon from a solid to permit reuse of the hydrocarbon and disposal or reuse of the solid. The invention thus has particular utility with processes for solvent extraction of solids. The invention broadly comprises a method for stripping adsorbed organics from a solid by feeding a slurry of a solid containing adsorbed organic into a packed column near one end; feeding a stripping gas into the column near the other end to countercurrently contact the slurry; removing an overhead stream from the column comprising desorbed organic solvent and the stripping gas; and removing a bottom stream from the column comprising a solvent stripped solid slurry. The feed into the column can also be termed a suspension, but for convenience the feed is described below as a slurry. The packed column of the invention is a horizontal or preferably a vertical column packed internally with devices/materials for increasing contact between the stripping gas and the solids. In the vertical packed column, the feed slurry enters near the column top and flows downward to contact upward flowing stripping gas entering near the bolumn bottom The countercurrent contact in a packed column containing no moving parts occurs at fast rates thus increasing the efficiency of an overall extraction process. In addition, the invention has the advantage of being able to desorb hydrocarbons from very high solid content slurries, for example, those with greater than 50 weight percent solids. The invention is useful in tar sand and other solid extractions. In addition, because the stripping is from a slurry, the invention has great utility in tar sand extraction methods which produce aqueous spent tar sand slurries, such as those described in commonly assigned copending patent applications Ser. No. 546,798, "Method for Solvent Treating of Tar Sand with Water Displacement", filed Oct. 31, 1983 and Ser. No. 546,828, "Method of Solvent Treating of Tar Sand with Water Displacement", filed Oct. 31, 1983.

The type of adsorbed organic solvent stripped from the solid varies with the nature of the solid and solute extracted therefrom. In general, any adsorbed organic solvent, such as hydrocarbons or chlorinated hydrocarbons, having a vapor pressure at least 0.1% of the vapor pressure of water at the stripper temperature can be stripped from a solid according to the invention. The stripping is more suitable for hydrocarbons immiscible with water because of easier separation from the overhead. Specific examples include extraction solvents for recovery of bitumen from tar sands, such as hydrocarbons having a carbon number of 1 through 20 and unsubstituted or substituted by at least one nitrogen, halogen, sulfur, or oxygen atom. Typical bitumen extraction solvents are saturated hydrocarbons of carbon number 3 through 9, such as heptane, or mixtures thereof such as a distillate fraction boiling about 80° C. to about 90° C. The adsorbed hydrocarbon content of the solid generally is below about 5 weight percent, although greater amounts can be stripped.

The types of solids containing adsorbed solvent treated are generally those which result from extraction of a solute from a solid material, where the adsorbed solvent is the extraction solvent. It is preferred to process spent tar sands resulting from bitumen or heavy crude oil (less than 20° API) extraction of bitumen containing tar sands, such as from Canada or Utah, or bitumen or heavy crude oil containing diatomite, such as from California. However, any solid containing an adsorbed organic solvent can be treated according to the invention for recovery of the solvent.

The solid containing adsorbed solvent is treated in a fluid slurry or suspension which is preferably an aqueous slurry to facilitate recovery of the organic solvent. The pH of the slurry varies depending on the solid and does not need to be adjusted, unless the pH adversely affects slurry rheology or system equilibrium. The solid content in the slurry can be any concentration, but is preferably above about 10 weight percent to increase solids hold-up in the column. It is also preferred to treat as high a solids content slurry as possible to minimize energy and water input. The maximum solids concentration is only limited by the pumpability of the slurry. Approximately 80 weight percent solids is the present upper limit of equipment. A workable range for tar sands is about 40 to about 70 weight % solids since these high solids slurries permit efficient contacting and are pumpable with conventional equipment. Any solid particle size distribution can be processed. For example, spent tar sands tailings containing particles ranging from 1 micron up to ⅜ inch have been processed without plugging of the column.

The stripping gas can be at least one of any gas such as air or inert gases such as nitrogen, $CO_2$, argon, or steam. Steam is particularly preferred for stripping water-immiscible organic solvents from water slurries because of easy separation from the recovered solvent and the elevated temperature and pressure of steam assists desorption. The amount of stripping gas fed into the column varies with slurry feed rate, the solvent volatility and amount, the slurry fluid, and the weight % solids. For example, the amount of steam used is that sufficient to heat the slurry and to form an azeotrope with the adsorbed organic. In general, about 0.05 to about 2.0 lb/min of the stripping gas are fed into the column to strip a feed slurry comprising about 1.0 lb/min, although greater amounts of gas can be used.

The packed column comprises a cylindrical shell in any length and diameter depending upon the amount of slurry to be processed, stripping gas rate and particular vapor liquid equilibria. A vertical column contains inlets near the top of the column for the volatile laden slurry and at the bottom of the column for the stripping gas. The vertical column has a bottom outlet for removing the desorbed solid slurry and an outlet at the column top for removing the overhead stream comprising stripping gas and the desorbed solvent. In the vertical column, the feed slurry flows downward in plug flow with little back-mixing and counter-currently contacts the upflowing stripping gas. Where the column is horizontal instead of vertical, one end is selected as the inlet of the slurry, the other end is for the slurry outlet, and the horizontal column is fluidized by injecting stripping gas at multiple points to achieve multi-stage co-current flow. In a horizontal column, a single or multiple outlets for the overhead stream comprising the stripped solvent can be located at any convenient place. Although the claims are directed to countercurrently contacting of the slurry with the stripping gas, they should be construed as including the horizontal column aspect of the invention. However, it is preferred to use a vertical column because it has lower pressure drop, lower stripping gas usage, and minimizes foaming problems.

The column is packed with suitable contact devices or materials such as bubble caps, sieve trays, disk/donut trays, or packings such a grid or fluted packings. The amount of packing used can be calculated by one skilled in the art and depends upon the amount of slurry processed in the column, the particular vapor/solid equilibria, and slurry rheology. The packing is preferably abrasion resistant. The surface area of the packing per cubic foot of packing can be any value, but the openings in the packing are preferably about twice the size of the largest particles in the feed. For example, a fluted packing with a flute height of ¾" and surface area of 42 $ft^2/ft^3$ worked well with ⅜" top size sand. A preferred packing is an organized, large diameter packing such as a fluted packing because tests in a fluted packed column showed excellent stripping and low pressure drop without plugging of a 65 weight percent solid slurry containing solids up to ⅜ inch in size, compared to bubble cap or sieve trays devices which require higher pressure drops and could exhibit plugging problems at a lower solids content.

The operation of the column is now examined in more detail with reference to the Figures. FIG. 1 shows a vertical stripping column where an aqueous volatile laden slurry 10 comprising, for example, spent tar sands tailings containing adsorbed heptane is introduced into packed stripper column 11. Stripping gas 12, for example, steam is fed into the column near the bottom. Volatile rich overhead 13 comprising the desorbed volatile solvent is removed and a stripped slurry 14 containing stripped solids is removed as a column bottom stream. The overhead is easily separated to recover the solvent, for example, by condensation and gravity phase separation.

The column operating temperature depends upon the volatility of the hydrocarbon to be stripped; higher boiling solvents require higher temperatures. When stripping spent tar sands, the temperature is within about 30° C. to about 200° C. although higher temperatures can be used. For example, pentane is removed at a temperature of about 60° C.-100° C. at atmospheric pressure. It is preferred to operate the column at as low a temperature as is economic for recovery of the desorbed organic vapor, because this minimizes cooling of the stripped bottom slurry. However, in some cases it can be preferable to operate at higher temperatures than overhead recovery requires to provide heat elsewhere in the plant.

A low pressure drop, for example below ½ psi per foot of packing, is preferred for the column, although any pressure drop can be used, for economic reasons. For example, the steam cost is logarithmically dependent upon steam pressure so lower pressure drops are important. It is also possible to operate the column under a vacuum.

The column is preferably operated under high solids loading conditions because stripping of the adsorbed hydrocarbon is mass transfer limited in the solid and liquid phases. In other words, the greater the solid content, the quicker the hydrocarbon desorption from the solid. Four ways to achieve higher solids loadings in the column are (1) operate the column in a near flood condition, i.e., at high input rates; (2) use weirs on sieve trays as the contact devices; (3) increase solids content of the slurry; and (4) input additional liquid directly onto the trays. A weir sieve tray arrangement is not preferred, however, because it increases risk of plugging the column at high solids contents, and additional liquid is not preferred because it decreases contact efficiency. Accordingly, it is preferable to operate the column at a near flood condition which can be determined by one skilled in the art and at high solids contents In general, a high liquid loading for a vertical column containing a packing of a capacity of 100 gallons per minute per square feet of column is operating at greater than 50 gallons per minute per square feet of column feed rate.

Figure 2:
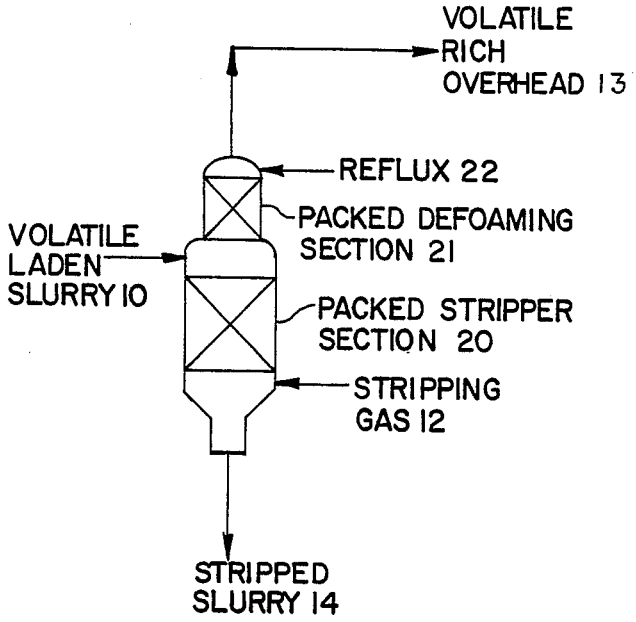
FIG. 2 shows a vertical stripping column designed for use with foaming slurries.

FIG. 2 shows an alternate embodiment of the stripping column of the invention which is particularly useful for feed slurries with foaming tendencies. The stripper column is composed of two sections, a packed foam scrubber section 21 on top of packed stripper section 20. The packed foam scrubber section is located above the volatile hydrocarbon laden slurry 10 feed point. The packing in the foam scrubber section is preferably of a higher surface area and thus has smaller openings in the packing than that in the stripping section. The column is also provided at the top with a reflux condenser 22 for reflux of the overhead. Alternatively, the top of the column can be refluxed with recovered solvent or slurry liquid from elsewhere in the plant. The vapors and foam entering the upper packed section are contacted with the slurry fluid reflux in countercurrent flow which scrubs the vapors free of foam. The volatile hydrocarbon rich gas 13 is removed as an overhead and is substantially foam free. The reflux can be hot to minimize the energy consumption, but a cold reflux is preferred because it provides more rapid defoaminq since it partially collapses the foam bubbles. A cold reflux also can be used to fractionate the slurry liquid from the volatile liquid.

Figure 3:
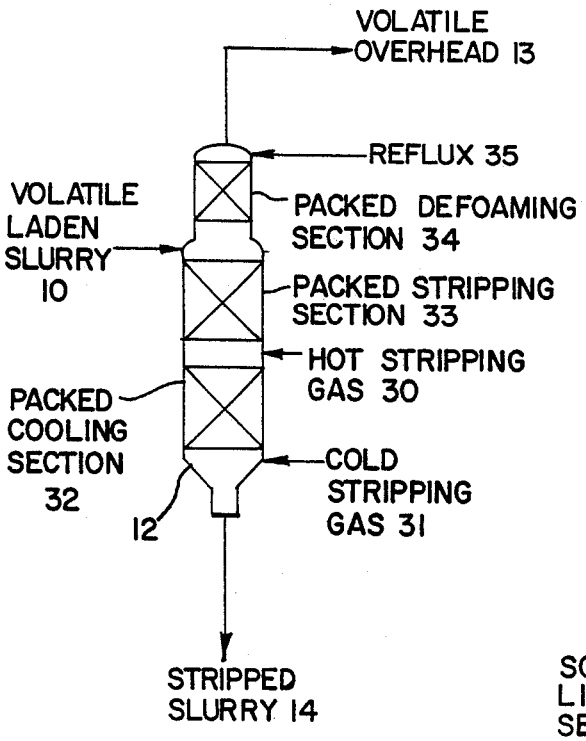
FIG. 3 shows another embodiment of the vertical stripping column.

FIG. 3 shows a preferred embodiment of the invention for use when: (1) the slurry fluid is volatile; or (2) the stripping temperature is near the saturation temperature of the slurry fluid as occurs in steam stripping of a water slurry. Volatile hydrocarbon laden solid slurry 10 is introduced near the top of the stripping column above packed stripping section 33 which is above the packed cooling section 32. Two stripping gas streams are fed into the column below the slurry feed point. A hot stripping gas 30, such as 50° C. to 150° C. steam, is fed at the bottom of the packed stripping section 33 and a cold stripping gas 31, such as 0° C.-90° C. nitrogen, air or $CO_2$ is fed near the bottom o.f packed cooling section 32. Also shown is a packed defoaming section 34 with reflux 35 above the slurry feed point, as in FIG. 2. The hydrocarbon rich gas 13 is removed as the overhead, at about 60°-100° C. for 100° C. steam, and the stripped slurry 14 is removed as a cold bottom stream at about 0° C.-90° C. In using two stripping sections, the lower section 32 recovers heat from the slurry by humidification of the cold stripping gas while further stripping the residual hydrocarbon from the solids. The humid hot vapor from the lower section substantially reduces the energy requirement and flow rate of the hot stripping gas 30, because of the heat and vapor recovered from the cooling of the slurry. The vapors from the lower stripping section do not have to be charged to the upper stripping section 33 because they can be used for other purposes such as energy conservation elsewhere in the plant. This can be useful because the vapors from the cold stripping section are relatively low in the stripped hydrocarbon and the presence of the second stripping gas may hinder recovery of the stripped hydrocarbon from the overhead from stripping section 33.

Figure 4:
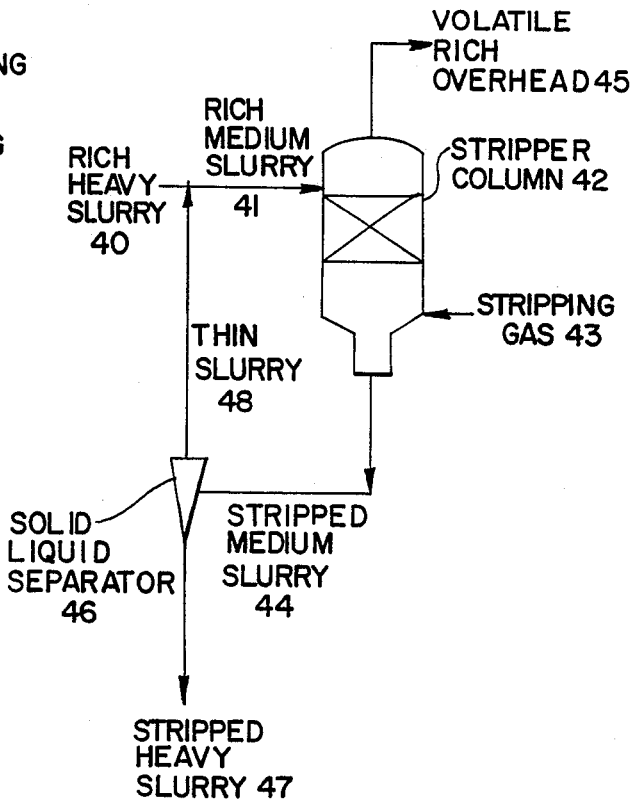
FIG. 4 depicts a flow scheme for dilution of the feed slurry to the vertical stripping column.

FIG. 4 shows an embodiment of the invention wherein the concentration of the feed slurry is maintained at an intermediate level by dilution of a relatively high solids content feed slurry. Here a rich heavy slurry 40 containing a solids content, for example, of above 80 weight percent is shown mixed at 41 with a thinner slurry 48. The resulting rich medium slurry of, for example 60 weight % solids is fed into the packed stripping column 42. The stripping gas 43 is fed below the input of the rich medium slurry and removes the desorbed volatile as overhead 13. The bottom stream is a stripped medium slurry 44 having a lower solids content than the rich heavy slurry 40. The stripped medium slurry enters a solid liquid separator 46, which is, for example, a hydrocyclone. The overflow stream from the hydrocyclone is the thin slurry 48. The underflow from the hydrocyclone is a stripped heavy slurry 47 and is sent for disposal. This embodiment maintains the solids weight concentration within an optimal range which depends on the solid being stripped while minimizing energy consumption. An optimal range, chosen by rheology and energy consumption, for a tar sands slurry is believed to be about 50 to 70 weight percent.

Examples 1 to 5 show the utility of the invention in stripping an adsorbed hydrocarbon from a solid in a packed column without plugging. The examples all involve steam stripping of spent tar sands tailings resulting from extraction of tar sands from Sunnyside, Utah comminuted to ⅜ top size before extraction. A 6 inch diameter vertical packed column containing 6 vertical feet of Munter's Plasdek, a sinusoidal shaped, fluted plastic packing material with a surface area of 42 $ft^2/ft^3$ of packing and flute height of ¾", was used. Aqueous slurries of spent tar sands containing 0.0625 pounds heptane per pound sand were used as feed to the column. Steam was fed as a stripping gas at the bottom of the column and an overhead stream containing water and desorbed heptane was removed as an overhead. The column was operated in all runs for about 15 minutes until steady temperatures were attained. Shown in Table 1 are data summarizing the five runs made including the weight percent of the solid feed slurry, the slurry feed rate, the steam rate, the volumetric flow rate in the column, and residual heptane content in the solids removed in the bottom stream. In all runs, no reflux was required to control foaming as the overhead stream was colorless and solids free. The column was operated in all runs at a emperature of about 70°–100° C. at ambient pressure, with a pressure drop of less than 0.1 psi. In all runs, the heptane recovery was above 98.5%.

| Run No. | Sand (wt %) | Feed Rate (lb/min) | Steam Rate (lb/min) | Volumetric Flow Rate ($gpm/ft^2$) | Residual Heptane (ppm) |
|---|---|---|---|---|---|
| 1 | 48.7 | 40.3 | 3.35 | 15.3 | 500 |
| 2 | 48.4 | 40.9 | 4.47 | 16.8 | 270–320 |
| 3 | 56.3 | 60.0 | 4.67 | 22.2 | 460 |
| 4 | 56.3 | 33.1 | 4.96 | 11.7 | 380 |
| 5 | 65.4 | 78.0 | 4.96 | 27.4 | 460–860 |

As seen in the examples, feed slurries containing 48.7 to 65.4 weight percent spent tar sand were stripped to below 500 ppm residual heptane in a vertical packed column. Run 5 is considered very significant because the solvent removal was excellent and steam consumption was lower, even though the column was operated at higher feed rate and solids content.

This stripping technique is considered to be a major process improvement for tar sands extraction processes as the equipment costs for packed columns are only a small fraction of costs for rotary stripping kilns conventionally used to treat the sand tailings. The total installed equipment costs for recovery of solvent from the tailings are less than one-fifth the cost of a design not using the vertical stripping column of the invention. Thus, one embodiment of the invention is extracting bitumen from bitumen containing tar sands or bitumen-containing diatomite with an organic solvent, separating a spent tar sands or spent diatomite containing adsorbed solvent; and steam stripping the solvent from a slurry of the spent sand or diatomite in a vertical packed column according to the invention.

The above discussion is intended to be merely illustrative and the full scope of the invention is given by the following claims.

I claim:

1. A method for stripping organic solvent from an aqueous feed slurry comprising a mixture of water and a solid containing adsorbed organic solvent using a vertical packed column containing: (1) an organized packing having an opening size at least about twice that of the largest solid particles in the feed slurry; (2) a hot stripping section located within said column; and (3) a cold stripping section located within said column and below the hot stripping sectiona dn being at a temperature less than the temperature of said hot stripping section; wherein;

(a) said feed slurry is introduced into an upper portion of the hot stripping section and a hot stripping gas is introduced into a lower portion of the hot stripping section;

(b) at least a portion of said adsorbed organic solvent is recovered from an upper portion of the vertical column as an overhead product;

(c) feed slurry having a reduced content of adsorbed organic solvent is passed from the hot stripping section into the cold stripping section;

(d) a cold stripping gas is passed into a lower portion of the cold stripping section, said cold stripping gas being at a temperature less than the temperature of said hot stripping gas; and (e) a stripped feed slurry substantially completed of organic solvent is recovered from a lower portion of the vertical column as a bottom product.

2. The method of claim 1 wherein the solid comprises spent tar sands tailings resulting from extraction of bitumen-containing tar sands or bitumen-containing diatomite.

3. The method of claim 1 wherein the solids content of the feed slurry is about 10 to about 80 weight percent.

4. The method of claim 1 wherein the stripping gas comprises at least one gas selected from the group consisting of air, nitrogen, carbon dioxide or steam.

5. The method of claim 1 wherein the column is operated at a temperature of about 30° C. to about 200° C.

6. The method of claim 1 wherein the vertical packed column contains a reflux section located above said hot stripping section.

7. The method of claim 6 wherein the feed slurry exhibits foaming.

8. The method of claim 1 further comprising separating the bottom product into a heavy slurry having a higher solids content than the bottom product and a thin slurry having a lower solids content than the bottom product and recycling the thin slurry to the feed slurry introduced into the packed column.

9. The method of claim 1 wherein the hot stripping gas is at a temperature of about 50° to about 150° C. and the cold stripping gas is at a temperature of about 30° to about 90° C.

10. The method of claim 1 wherein the hot stripping gas comprises steam and the cold stripping gas comprises nitrogen, air, or $CO_2$.

11. A method for stripping organic extraction solvent from an aqueous feed slurry comprising a mixture of water and spent tar sands tailings containing adsorbed organic extraction solvent using a vertical packed column containing: (1) an organized packing having an opening size at least about twice that of the largest solids particles in the feed slurry; (2) a hot stripping sections located within said column; and (3) a cold stripping section located withing said column and below the hot stripping section and being at a temperature less than the temperature of said hot stripping section; wherein:

(a) said feed slurry is introduced into an upper portion of the hot stripping section and a hot stripping gas comprising steam is introduced into a lower portion of the hot stripping section;

(b) at least a portion of said organic solvent is recovered from an upper portion of the vertical column as an overhead product;

(c) feed slurry having a reduced content of adsorbed organic solvent is passed from the hot stripping section into the cold stripping section;

(d) a cold stripping gas being at a temperature less than the temperature of said hot stripping gas and comprising at least one material selected from the group consisting of air, nitrogen, and carbon dioxide is passed into a lower portion of the cold stripping section; and (e) a stripped feed slurry substantially depleted of organic solvent is recovered from a lower portion of the vertical column as a bottom product.

12. The method of claim 11 wherein the extraction solvent is an unsubstituted hydrocarbon or a substituted hydrocarbon substituted by at least one halogen, nitrogen, sulfur or oxygen atom and containing from 1 to 20 carbon atoms.

13. The method of claim 11 wherein the extraction solvent is a hydrocarbon containing 3 to 9 carbon atoms or mixtures thereof.

14. The method of claim 11 wherein the hydrocarbon is a distillate fraction boiling at about 80° C. to about 90° C.

15. The method of claim 11 wherein column operating temperature is about 30° C. to about 200° C.

16. The method of claim 11 wherein spent tar sands content in the feed slurry is about 10 to about 80 weight percent.

17. The method of claim 11 wherein spent tar sands content in the aqueous slurry is about 50 to about 70 weight percent.

18. A method for stripping organic extraction solvent from an aqueous feed slurry comprising a mixture of water and at least about 50 percent by weight of spent tar sands tailings containing adsorbed organic extraction solvent using a vertical packed column containing: (1) an organized packing having an opening size at least about twice that of the largest solids particles in the feed slurry; (2) a hot stripping section located within said column; and (3) a cold stripping section located within said column and below the hot stripping section and being at a temperature less than the temperature of said hot stripping section; wherein:

(a) said feed slurry is introduced into an upper portion of the hot stripping section and a hot stripping gas comprising steam is introduced into a lower portion of the hot stripping section;

(b) at least a portion of said organic solvent is recovered from an upper portion of the vertical column as an overhead product;

(c) feed slurry having a reduced content of adsorbed organic solvent is passed from the hot stripping section into the cold stripping section;

(d) a cold stripping gas being at a temperature less than the temperature of said hot stripping gas and comprising at least one material selected from the group consisting of air, nitrogen, and carbon dioxide is passed into a lower portion of the cold stripping section; and (e) a stripped feed slurry is recovered from a lower portion of the vertical column as a bottom product.

19. The method of claim 18 wherein the solvent is a hydrocarbon of carbon number 3 to 9, or mixtures thereof.

20. The method of claim 18 wherein spent tar sands concentration in the aqueous slurry is from about 50 to about 70 weight percent.

21. The method of claim 18 wherein the vertical packed column is packed with a fluted packing material.

22. The method of claim 19 wherein the column operating temperature is about 30° C. to about 200° C.

* * * * *

UNITED STATES PATENT OFFICE
CERTIFICATE OF CORRECTION

Patent No. 4,802,975 Dated February 7, 1989

Inventor(s) Robert L. Mehlberg

It is certified that error appears in the above-identified patent and that said Letters Patent is hereby corrected as shown below:

| Column | Line | |
|---|---|---|
| Abstract | 19 | "th" should read --the-- |
| 1 | 6 | "are" should read --and-- |
| 3 | 2 | "bolumn bottom" should read --column bottom.-- |
| 4 | 46 | "a" should read --as-- |
| 5 | 47 | "contents" should read --contents.-- |
| 6 | 20 | "o.f" should read --of-- |
| 6 | 64 | "to 70" should read --to about 70-- |
| 7 | 21 | "emperature" should read --temperature-- |
| 7 | 68 | "sectiona dn" should read --section and-- |
| 8 | 2 | "wherein;" should read --wherein:-- |
| 8 | 17 | "completed" should read --depleted-- |
| 8 | 57 | "sections" should read --section-- |
| 8 | 58 | "withing" should read --within-- |

Signed and Sealed this

Eleventh Day of July, 1989

*Attest:*

*Attesting Officer*

DONALD J. QUIGG

*Commissioner of Patents and Trademarks*